US006234839B1

(12) United States Patent
Zhang

(10) Patent No.: US 6,234,839 B1
(45) Date of Patent: May 22, 2001

(54) CONNECTOR WITH AN IMPROVED HOUSING

(75) Inventor: Guohua Zhang, Kunsan (CN)

(73) Assignee: Hon Hai Precision Ind. Co., Ltd., Taiepi Hsien (TW)

( * ) Notice: Subject to any disclaimer, the term of this patent is extended or adjusted under 35 U.S.C. 154(b) by 0 days.

(21) Appl. No.: 09/473,784

(22) Filed: Dec. 29, 1999

(51) Int. Cl.[7] ..... H01R 13/422
(52) U.S. Cl. ..... 439/595; 439/733.1
(58) Field of Search ..... 439/752.5, 733.1, 439/79, 595

(56) References Cited

U.S. PATENT DOCUMENTS 4,317,609 * 3/1982 Larpaik ..... 439/752.5
5,226,839 * 7/1993 Koumatsu et al. ..... 439/752.5
5,716,232 * 2/1998 Endo et al. ..... 439/752.5

* cited by examiner

*Primary Examiner*—Gary F. Paumen
(74) *Attorney, Agent, or Firm*—Wei Te Chung

(57) ABSTRACT

An electrical connector of the present invention comprises an insulative housing defining a plurality of long and short contact receiving slots and a plurality of corresponding long and short contacts received in the corresponding long and short contact receiving slots. Each slot comprises a horizontal passage and a vertical passage. A notch is defined on a front end of a supporting wall of the horizontal passage of the long contact receiving slot. A cantilever member upwardly extends from a bottom of the notch for interfering with and applying elastic pressure on an embossment of the long contact thus assuring proper orientation of the long contact in the housing.

1 Claim, 5 Drawing Sheets

CONNECTOR WITH AN IMPROVED HOUSING

BACKGROUND OF THE INVENTION

1. The Field of the Present Invention

The present invention relates to a connector, and particularly to an electrical connector with an improved housing for fixing contacts therein.

2. Description of the Prior Art

An electrical connector is mounted between electronic devices for transmitting electrical signals therebetween. Contacts must be reliably positioned in the connector to secure reliable signal transmission. A prior art connector is disclosed in Taiwan patent application No. 86207970 shown in FIGS. 4–5. A conventional connector 3 comprises an insulative housing 4 and a plurality of contacts 5. The housing 4 has a bottom wall 41 with a step-shaped portion 40 at a front end thereof. Step-shaped contact receiving slots 42 are defined through the step-shaped portion 40 having a first receiving portion 44 and a second receiving portion 45 for receiving an extending portion 51 of a corresponding contact 5.

Production of the prior art housing 4 required a high precision mold to control the breadth of the contact receiving slots 42 to assure a proper fit of the contacts 5 therein. If the breadth of the contact receiving slots 42 are slightly narrower than that of the contacts 5, the contacts 5 can be easily deformed or damaged while being pressed into the housing 4. If the breadth of the contact receiving slots 42 are slightly wider than that of the contacts 5, the contact 5 can be easily displaced from its position. Furthermore, a small displacement of the extending potion end 51 of the contact can result in a comparatively large displacement at the engaging portion end 52.

Accordingly, an improved electrical connector is required to overcome the disadvantages of the prior art

BRIEF SUMMARY OF THE INVENTION

A first object of the present invention is to provide an electrical connector with an improved housing for orienting contacts therein.

A second object of the present invention is to provide an electrical connector wherein the housing is made of a material of the elasticity so that a cantilever member of a supporting wall of a long horizontal passage can apply effective elastic pressure on a long contact properly orienting the contact therein.

Other objects, advantages and novel features of the invention will become more apparent from the following detailed description of the present embodiment when taken in conjunction with the accompanying drawings.

An electrical connector of the present invention comprises an insulative housing and a plurality of contacts. The housing defines a plurality of long and short contact receiving slots which are adjacent and parallel to each other. Each contact receiving slot comprises a horizontal passage and a vertical passage through the housing. A notch is defined at a front end of a supporting wall of each long horizontal passage. A cantilever member upwardly extends from a bottom of the notch and projects slightly inward towards the long horizontal passage. The long and short contacts are received in the corresponding long and short contact receiving slots. Each contact comprises a horizontal section, a base section and an engaging section extending from the base section and perpendicular to the horizontal section. The horizontal section forms an embossment and has a solder tail for soldering to a printed circuit board. During assembly the contacts are inserted in the contact receiving slots, the cantilever member of the long contact receiving slots bending and applying elastic pressure on the embossments of the long contacts so that the long contacts are properly oriented in the housing.

DETAILED DESCRIPTION OF THE INVENTION

Figure 1:
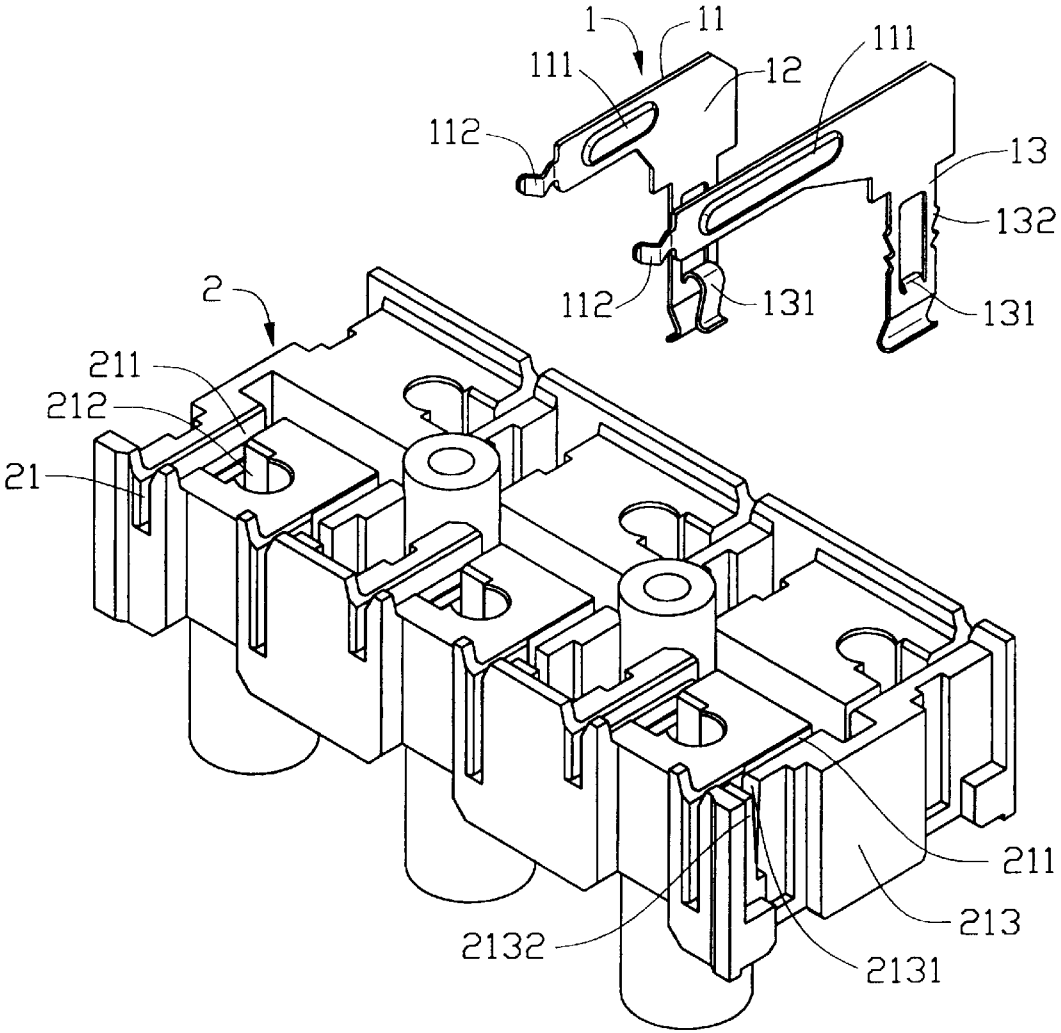
FIG. 1 is an exploded view of an electrical connector in accordance with the present invention.

Referring to FIG. 1, an electrical connector in accordance with the present invention comprises an insulative housing 2 and a plurality of contacts 1. The insulative housing 2 defines a plurality of contact receiving slots 21, each slot comprising a horizontal passage 211 and a vertical passage 212 perpendicular to the horizontal passage 211 and extending through the housing 2. The contact receiving slots 21 are differentiated long and short contact receiving slots based on the length of their horizontal passages. Each long contact receiving slot is adjacent and parallel to a short contact receiving slot. A notch 2131 is defined at a front end of a supporting wall 213 of each long horizontal passage 211. A cantilever member 2132 upwardly extends from a bottom of the notch 2131 and slightly projects inward toward the horizontal passage 211 of the contact receiving slot 21. The housing 2 is made of an elastic material, such as nylon and LCP, so that the cantilever member is flexible.

Each contact 1 comprises a horizontal section 11, a base section 12 and an engaging section 13 extending from the base section 12 and perpendicular to the horizontal section 11. The contacts 1 are differentiated into long and short contacts on base the length of their horizontal section 11. The horizontal section 11 forms an embossment 111 thereon for increasing deformation strength and has a solder tail 112 at a distal end for soldering to a printed circuit board. The engaging section 13 is provided with a spring tab 131 for contacting a mating element and forms barbs 132 on both sides thereof for interfering with a inner wall of the vertical passage 212.

Figure 2:
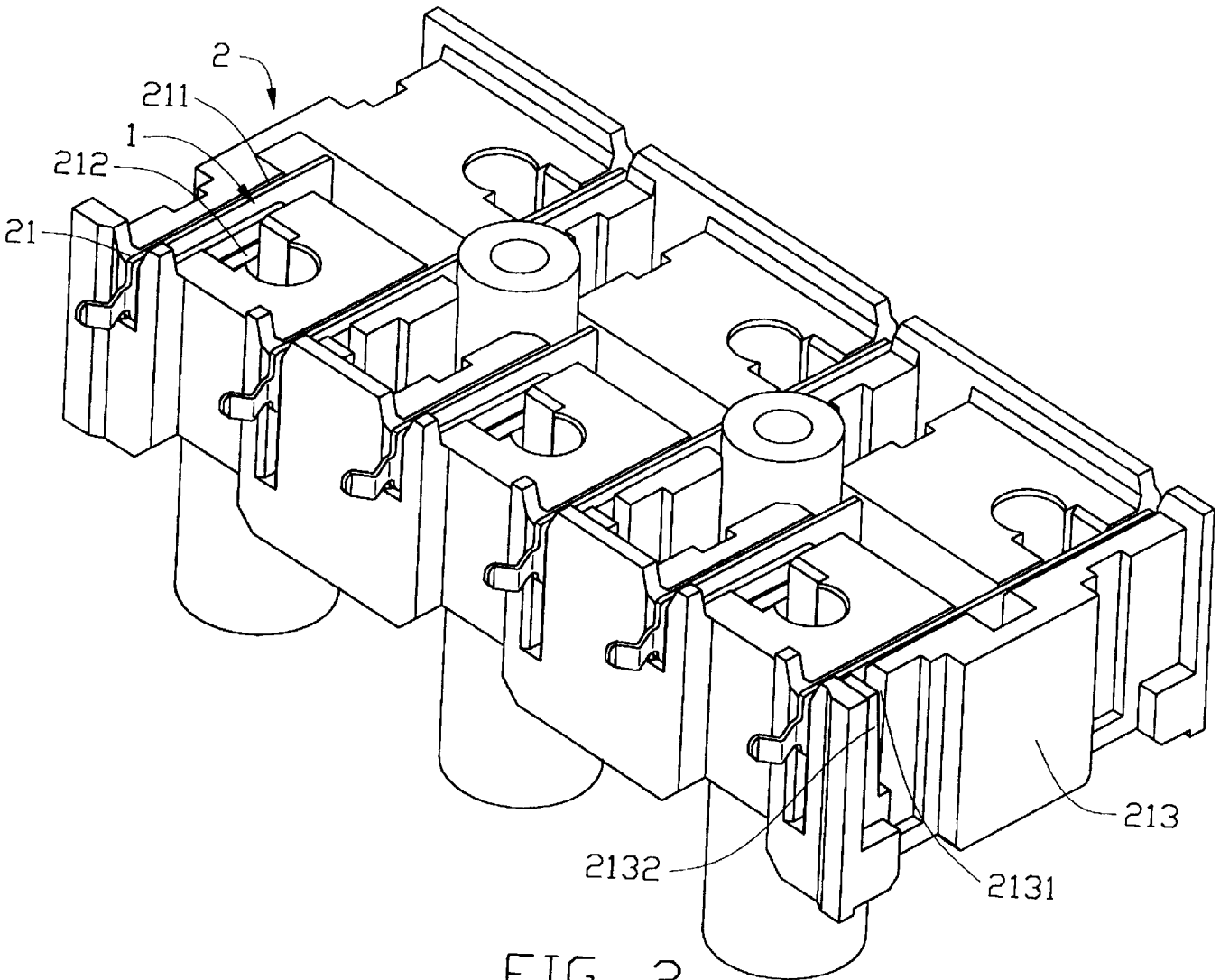
FIG. 2 is an assembled view of the electrical connector of FIG. 1.
Figure 3:
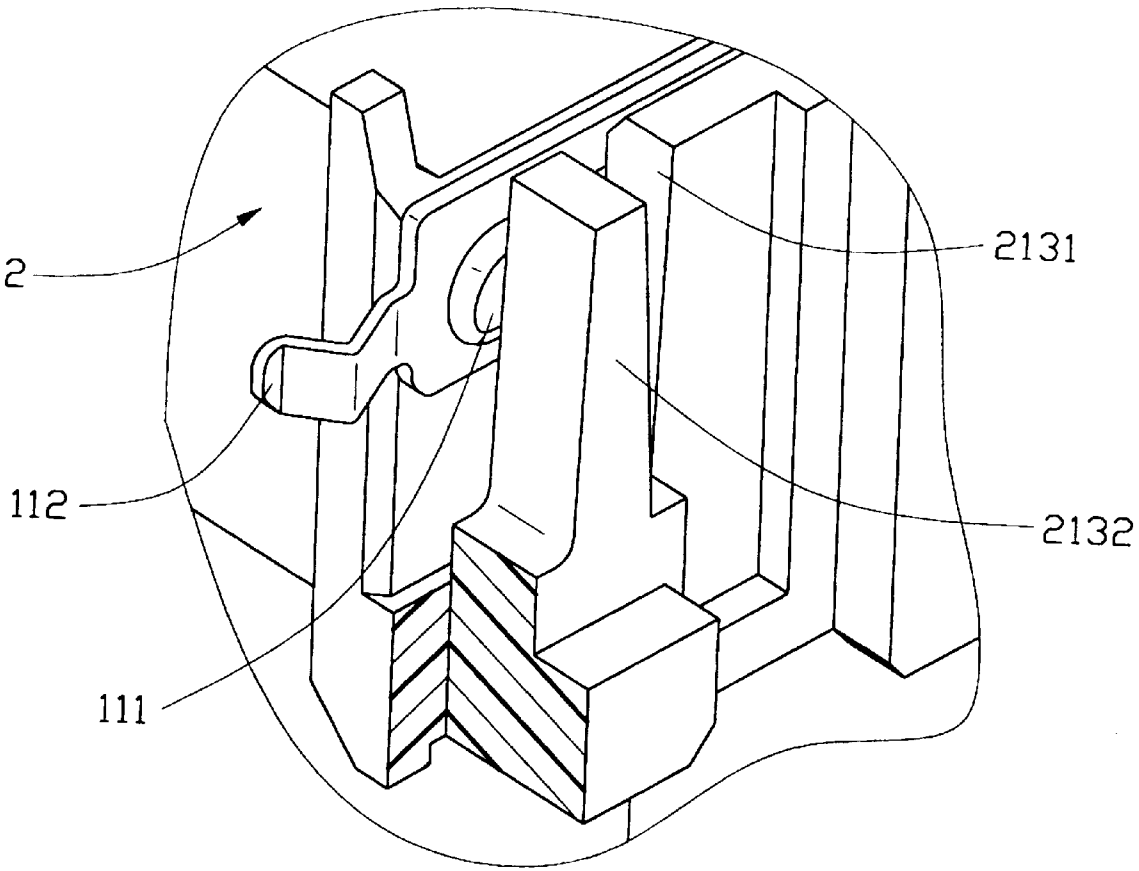
FIG. 3 is a locally enlarged cut-away view of a long contact and a housing in assembly, specifically showing the engagement between the cantilever member of the housing and an embossment of the long contact.
Figure 4:
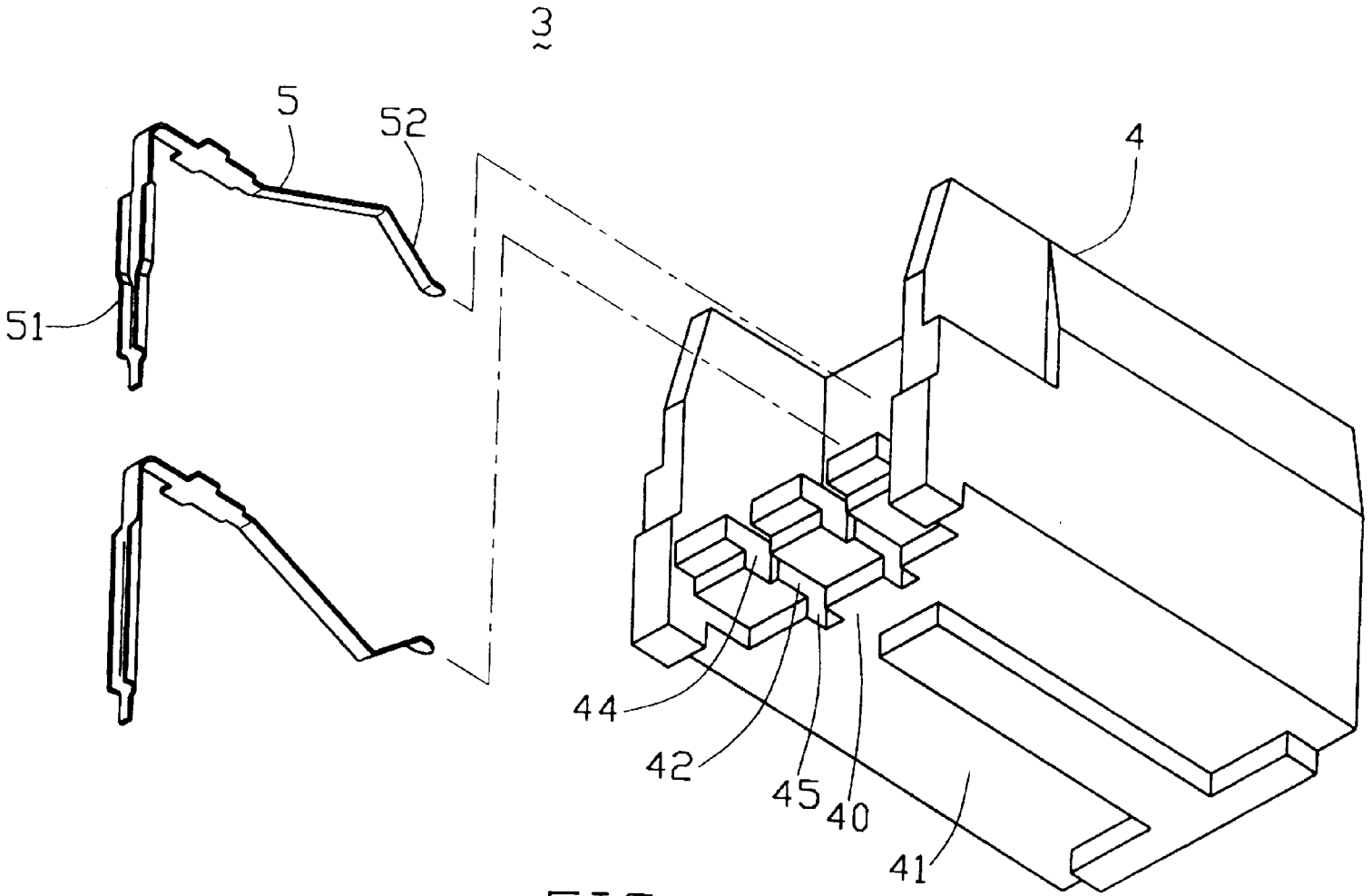
FIG. 4 (PRIOR ART)
FIG. 4 is an exploded view of a conventional electrical connector.
Figure 5:
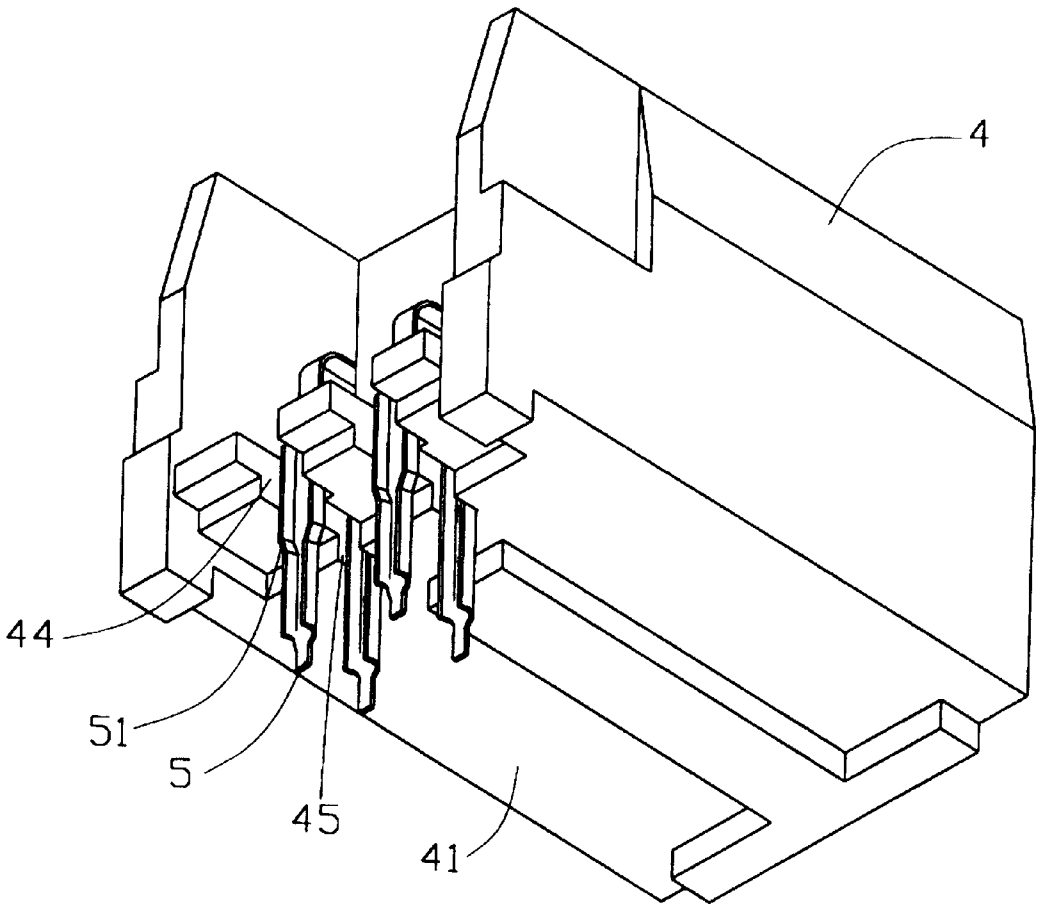
FIG. 5 (PRIOR ART)
FIG. 5 is an assembled view of the connector of FIG. 4.

Now referring to FIGS. 2–3, in assembly, the long and short contacts 1 are received in corresponding long and short contact receiving slots 21, each horizontal section 11 being received in the horizontal passage 211 and the engaging section 13 being received in the vertical passage 212. The cantilever member 2132 slightly inclines and applies elastic pressure on the embossment of each long contact 1 so that the contact 1 is properly oriented in the housing 2 and is not easily damaged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a plurality of long and short contact receiving slots and one or more supporting walls each partly defining a corresponding one of the long contact receiving slots, each contact receiving slot comprising a horizontal passage and a vertical passage, a notch being defined at a front end of the respective supporting wall near the horizontal passage of the respective long contact receiving slot, a cantilever member upwardly extending from a bottom of the notch and slightly projecting into the horizontal passage; and a plurality of long and short contacts respectively received in the long and short contact receiving slots, each long contact comprising a horizontal section forming an embossment, a base section and an engaging section secured in the vertical passage, the embossment of the long contact being pressed by the cantilever member of the supporting wall, thereby firmly positioning the horizontal section of the long contact in the horizontal passage of the long contact receiving slot;

wherein the thickness of the horizontal section of the long contacts is greater than the breadth of the horizontal passage of the long contact receiving slots minus the distance the unstressed cantilever member projects into the horizontal passage.

* * * * *